US005515555A

United States Patent [19]

Wörmcke

[11] Patent Number: 5,515,555

[45] Date of Patent: May 14, 1996

[54] DEVICE FOR CONTROLLING THE OPERATION OF A VACUUM TOILET

[75] Inventor: Hans H. Wörmcke, Heist, Germany

[73] Assignee: Sanivac Vakuumtechnik GmbH, Wedel, Germany

[21] Appl. No.: 351,376

[22] PCT Filed: Jan. 13, 1994

[86] PCT No.: PCT/EP94/00085

§ 371 Date: Dec. 9, 1994

§ 102(e) Date: Dec. 9, 1994

[87] PCT Pub. No.: WO94/16158

PCT Pub. Date: Jul. 21, 1994

[30] Foreign Application Priority Data

Jan. 16, 1993 [DE] Germany ..... 9300534 U

[51] Int. Cl.[6] ..... E03D 11/00

[52] U.S. Cl. ..... 4/431; 4/661

[58] Field of Search ..... 4/300, 316, 431, 4/434, 661

[56] References Cited

U.S. PATENT DOCUMENTS

| | | | |
|---|---|---|---|
| 4,214,324 | 7/1980 | Kemper et al. | 4/316 X |
| 4,357,719 | 11/1982 | Badger et al. | 4/431 X |
| 4,592,505 | 6/1986 | Bruninga et al. | 239/69 |
| 4,760,547 | 7/1988 | Duxbury | 364/420 |
| 4,791,688 | 12/1988 | Krishnakumar et al. | 4/316 X |
| 4,937,732 | 6/1990 | Brundisini | 364/145 |

FOREIGN PATENT DOCUMENTS

| | | |
|---|---|---|
| 0277786 | 8/1988 | European Pat. Off. . |
| 0331461 | 9/1989 | European Pat. Off. . |

OTHER PUBLICATIONS

Fujita, English language abstract of JP 1-207,539, Aug. 21, 1989, 1 pg.

*Primary Examiner*—Robert M. Fetsuga
*Attorney, Agent, or Firm*—Lane, Aitken & McCann

[57] ABSTRACT

A device for controlling the operation of a vacuum toilet has a control computer integrated below the toilet seat, time-controlledunits such as vacuum and compressed air generators with their corresponding closing and opening valves, and sensors for temperature, pressure and flow. An accessory control appliance or hand terminal is connectable to the control computer by a standardised interface, may control all required functions in parallel with the control computer, and allows manual input of the operation parameters. Device is also provided for outputting the content of a control device storage unit integrated into the control computer and storing over any time period the values for the operations effected.

1 Claim, 1 Drawing Sheet

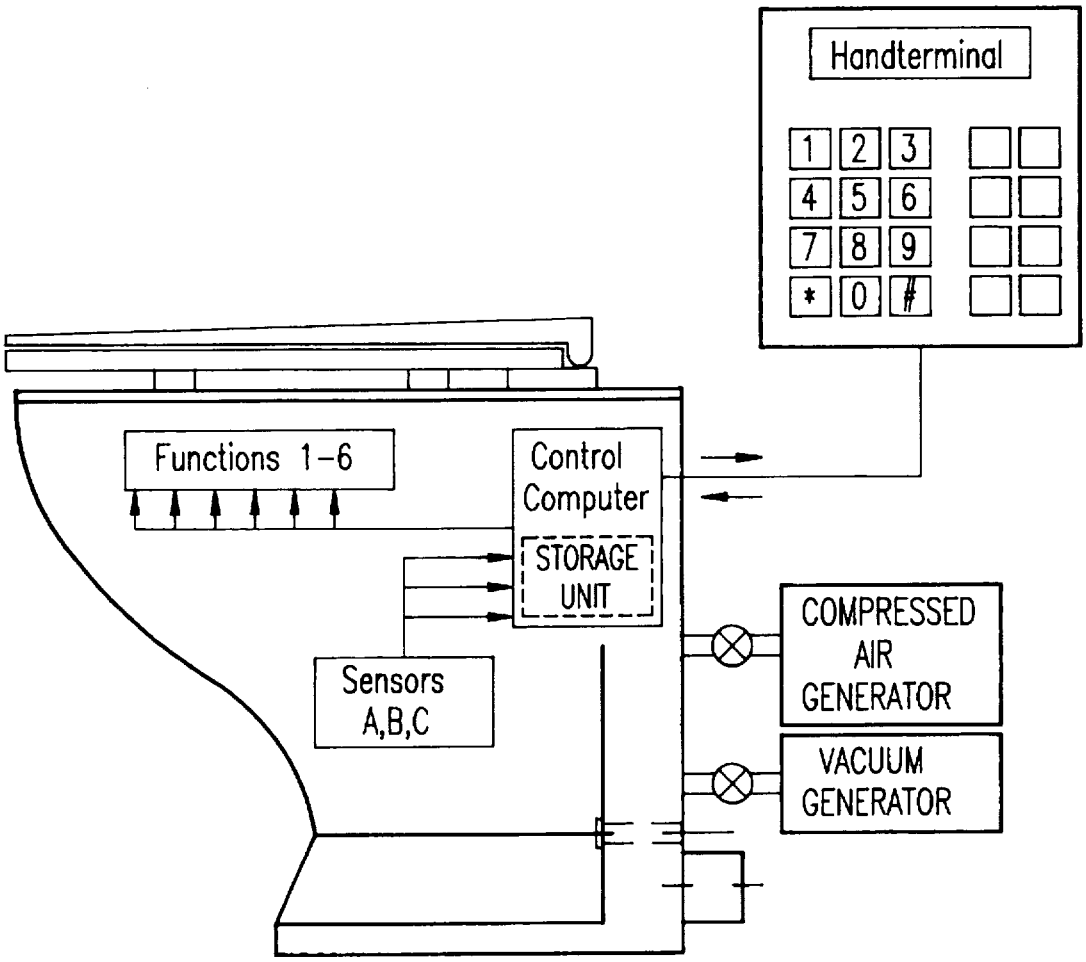
Handterminal
1 2 3
4 5 6
7 8 9
* 0 #
Functions 1-6
Control Computer
STORAGE UNIT
Sensors A,B,C
COMPRESSED AIR GENERATOR
VACUUM GENERATOR

DEVICE FOR CONTROLLING THE OPERATION OF A VACUUM TOILET

The invention relates to a device for controlling the processes that take place in the operation of a vacuum toilet, comprising a control computer installed below the seat of a toilet, time-controlled assemblies such as vacuum and compressed air generators with associated closing and opening valves, and sensors for temperature, pressure, and flow.

In the operation of a vacuum toilet a number of processes are carded out which must be precisely coordinated with each other in time. What are involved are essentially flushing and emptying processes. In order for it to be possible to carry out these flushing and emptying processes vacuum or pressure generators must be activated in order to make the necessary motive forces available for the transport processes. Some of the functions may be performed in parallel, while others must be carried out in a precise sequence in time, with the user himself simply giving a trigger signal. Even in troublefree operation the entire control operation is complicated and also depends on external input quantities which must be monitored by means of sensors. These input quantities include the temperature, since if it falls below a value at which the flush water freezes, any use of the vacuum toilet must be prevented.

Hence it is customary in state-of-the-art control systems to use a control computer that operates in accordance with a certain program, specific base values being assigned to the program in advance.

In a state-of-the-art control system of this kind, operational reliability depends on preset values arrived at more or less empirically by long-term experience. While a control computer such as this may also be reprogrammed after the fact, such computers present the disadvantage that such reprogramming fails to allow for the conditions under which the toilet was used in the past. These conditions may be totally different if it is assumed that a toilet installed in a train may have been used at temperatures that may have been significantly below freezing or far above 30 degrees.

The aim of the invention is to create a device of the type described in the foregoing so that it may be modified quickly from the viewpoint of its control, and in particular so that it may be adapted to special circumstances that have arisen in the past. To be added is the fact that statistics may be compiled on errors that have occurred and on their particular features.

This is accomplished by means of the features claimed for the invention.

It is essential for this invention that the control computer be provided with means for storing values, such as an additional storage unit, that is capable of storing the characteristic values of all processes of operations carried out over a specific period of time. Such a period may extend, for example, over several weeks or even several months. On the basis of such storage values are available at any time that may be used again in order to adapt automatic control of the process as required for the future. The storage unit in the control computer also provides information on malfunctions and erroneous operation, so that feedback is possible in this respect as well.

The second essential feature of this invention is the provision of handheld means for controlling the operation processes, such as a handheld terminal, which is suitable both for input of data and output of data. Hence the terminal includes means for entering parameters of the operation processes into the computer by hand whereby new values may be registered, and printouts may also be obtained which reflect the processes with precision.

The invention is described by way of an exemplary embodiment with reference to the drawing.

The only FIGURE of the drawing shows a control device as claimed for the invention.

The invention relates to a device for controlling the processes that take place in the operation of a vacuum toilet, comprising a control computer installed below the seat of a toilet, time-controlled assemblies such as vacuum and compressed air generators with associated closing and opening valves, and sensors for temperature, pressure, and flow.

The FIGURE shows a control computer below the seat of a vacuum toilet; this computer operates in conjunction with assemblies indicated by a block diagram in which functions 1–6 are identified. Letters A, B, C refer to sensors in a block and appropriate arrows indicate that these sensors transmit their values to the control computer.

A suitable storage unit is mounted inside the control computer. Means is provided for transmitting data from the handheld terminal to the control computer. The control computer is provided with an interface, such a standard RS232 interface, with which the handheld terminal is also provided. Consequently, a data transmission connection between the control computer, together with its storage unit, and the handheld terminal can be established by means of a simple plug connection.

The processes designated as functions 1–6 are the following.

1. Evacuation of the intermediate tank
2. Flushing of the toilet bowl
3. Filling of the flushing water tank
4. Opening of the inlet valve (bowl-intermediate tank)
5. Compressed air filling of the intermediate tank
6. Opening of the outlet valve These functions are activated by the control computer at specific preset times within an emptying cycle. The emptying cycle is initiated by a start button, not shown, and ends automatically.

Four sensors (1 pressure sensor, 2 water sensors, and a temperature sensor) are monitored constantly by the control computer in order to prevent malfunctions due to lack of flushing water, lack of compressed air, flow obstruction, bowl overflow, and below-freezing temperatures.

In the event of a failure, automatic failure correction action is initiated and, if necessary, should failure correction action prove to be unsuccessful, routine operation is suspended (in which event initiation of an emptying cycle is no longer possible).

All registered values of eight counters are stored internally by the control computer. They provide information on the number of flushings that have occurred previously and on the number of different failures that have occurred since commissioning of the device.

I claim:

1. In combination, a vacuum toilet having a seat, time-controlled assemblies including a vacuum generator, a compressed air generator, and valves associated with said generators, and sensors for temperature, pressure and flow, and a device for controlling operation processes in the operation of the vacuum toilet, comprising:

a control computer, said control computer including means for storing values representing operation processes completed over a period of time;

handheld means for controlling the operation processes, said handheld means comprising a hand-borne terminal, and said hand-borne terminal further comprising means for entering parameters of the operation processes into the computer by hand; and means for transmitting data from said hand-borne terminal to said control computer.

* * * * *

UNITED STATES PATENT AND TRADEMARK OFFICE

CERTIFICATE OF CORRECTION

PATENT NO. : 5,515,555

DATED : May 14, 1996

INVENTOR(S) : Hans H. Wörmcke

It is certified that error appears in the above-indentified patent and that said Letters Patent is hereby corrected as shown below:

Column 1, line 12, "carded" should read "carried".

Signed and Sealed this

Twenty-ninth Day of October 1996

*Attest:*

BRUCE LEHMAN

*Attesting Officer*

*Commissioner of Patents and Trademarks*